United States Patent [19]

Crama et al.

[11] Patent Number: 4,490,174

[45] Date of Patent: Dec. 25, 1984

[54] PROCESS FOR THE PREPARATION OF A FERRONICKEL CONCENTRATE

[76] Inventors: Willem J. Crama; Albertus H. Baas, both of Westervoortsedijk 67D, 6827 AT Arnhem, Netherlands

[21] Appl. No.: 556,655

[22] Filed: Nov. 30, 1983

[30] Foreign Application Priority Data

Dec. 22, 1982 [NL] Netherlands ..... 8204940

[51] Int. Cl.[3] ..... C22B 23/00

[52] U.S. Cl. ..... 75/82; 75/1 R

[58] Field of Search ..... 75/1 R, 82

[56] References Cited

U.S. PATENT DOCUMENTS 3,318,689 5/1967 Zubryckyj ..... 75/1 R 3,503,734 3/1970 Bell ..... 75/1 R

*Primary Examiner*—Peter D. Rosenberg

*Attorney, Agent, or Firm*—Jones, Tullar & Cooper

[57] ABSTRACT

A ferronickel concentrate is produced by reducing a lateritic ore comprising less than 1.5% w of nickel at a temperature of from 920° to 1120° C. with a $CO/CO_2$ mixture in the presence of a S-compound, such as $Na_2SO_4$ or $FeSO_4$ or FeS, and subjecting the reduced product to magnetic separation.

10 Claims, No Drawings

PROCESS FOR THE PREPARATION OF A FERRONICKEL CONCENTRATE

The invention relates to a process for the preparation of a ferronickel concentrate by reduction of a lateritic nickel and iron ore.

Commercial production of nickel from lateritic nickel and iron ores is practised on a large scale, as far as the ores in question have a nickel content of above 1.5%w. Recovery is more difficult when the nickel content of the ore is below this figure. In mines producing ores with a varying nickel content this often means that ores containing less than 1.5%w of nickel are discarded and only the higher grade ores are exploited. Methods have therefore been sought by which nickel could nevertheless be suitably recovered from these poorer ores.

It would be attractive to reduce the oxidic nickel in the ore to nickel or ferronickel and to free the desired product from the far greater quantities of gangue with the aid of magnetic separation. Success in this would, however, be conditional on the reduction being carried out under such conditions that the particle growth of the metallic ferronickel phase proceeds to a stage at which the particle size is sufficient for effective magnetic separation to be applied.

It has now been found that the desired particle growth can take place when the reduction is carried out (1) at high temperatures, (2) in the presence of a sulphur compound and (3) with a gas mixture containing CO and $CO_2$ in a ratio between critical limits. Reduction by means of a gas mixture means that the process differs from the known segregation process based on precipitation of nickel onto carbon particles introduced into the process together with metal chlorides for converting nickel oxide into nickel chloride which is then reduced with hydrogen produced by reacting carbon with water vapour.

The invention relates to a process for the preparation of a ferronickel concentrate by reduction of a lateritic ore containing 0.25 to 1.5%w of nickel and 10 to 50% iron at a temperature of 920° to 1120° C. with a gas mixture containing CO and $CO_2$ in a molar ratio of from 60:40 to 100:0, in the presence of a sulphur compound, whereafter the reaction product is ground and magnetically separated, a magnetic fraction being obtained which contains a maximum of 35% of the iron present in the ore.

The above-mentioned limit means that the reduction should not be continued beyond the point at which the production of zero-valent iron by reaction of iron oxide reaches a conversion of 35%. Preferably, a maximum value of 25% should be adhered to. The reason for this is that the main object of the invention is to obtain a maximum conversion of oxidic nickel into zero-valent nickel. The reduction of iron is of subordinate importance and complete reduction of iron oxide to zero-valent iron is avoided, since this would only introduce an unnecessary complication. Varying the ratio of CO and $CO_2$ in the reducing gas mixture has the effect of varying the selectivity of the reduction (=preferential reduction of nickel in respect of reduction of iron): the smaller the ratio, the higher the selectivity. On the other hand, the yield of zero-valent nickel in the magnetic fraction decreases (i.e. nickel losses therefore increase) as the $CO/CO_2$ ratio falls to values below 60:40. The preferred ratio $CO/CO_2$ is from 65:35 to 85:15. The total amount of reducing $CO/CO_2$ gas brought into contact with the ore is generally between 2 and 20 mol CO per mol oxidic nickel, preferably between 5 and 15 mol. It is advisable not to pass the gas mixture too quickly through, over, or along the ground ore, which is why relatively low gas flow rates and relatively long reaction times are used. Preferred reaction times are between 0.5 and 7 hours. For large-scale operations the reaction time can be reduced to 3 hours or less. Suitable reaction temperatures are from 920° to 1120° C., preferably between 950° and 1050° C.

The purpose of the sulphur compound is to promote the particle growth of the metallic phase during the reaction. Many sulphur compounds can be used, e.g. $(NH_4)_2SO_4$, $CuSO_4$, $FeSO_4$ or $Fe_2(SO_4)_3$. Alkali metal sulphates, alkaline earth metal sulphates, $FeS_2$ and FeS are particularly preferred. Good examples are: $Na_2SO_4$, $K_2SO_4$, $BaSO_4$, $CaSO_4$, of which the first of these is particularly suitable. Appropriate amounts of the sulphur compound are between 1.5 and 10%w, calculated as sulphur to oxidic iron, the preferred range being from 3 to 7%w.

The practical test by which to judge whether sufficient particle growth has taken place is simply whether or not magnetic separation properly works. It is therefore unnecessary to express the desired degree of particle growth of the metallic ferronickel phase as growth until a particular minimum size of, say, 5 or 15 micrometers has been exceeded. The required minimum size is, moreover, not the same for all ores but can vary between relatively wide limits. Nevertheless, a minimum size of 5 micrometers can be considered as a general guideline for successful operation.

As the invention also provides for the possibility of influencing the selectivity of the reduction reaction, it will be clear that the nickel content in the ferronickel obtained can be varied within relatively wide limits. Ferronickel compositions with nickel contents between 4 and 50% will generally be aimed at.

The non-magnetic fraction contains a part of the originally present iron compounds and the major part of the gangue. The magnetic concentrate contains ferronickel and remaining part of the gangue. The amount of gangue in the resulting ferronickel concentrate is usually between 40 and 80%w, the rest being ferronickel. Further dressing of the ferronickel concentrate can be done in manners known per se.

In a preferred embodiment of the process of this invention a ferronickel concentrate is produced by introducing a mixture of a sulphur compound and a ground lateritic ore containing 0.25 to 1.5%w of nickel and 10 to 50%w of iron oxide into a furnace, heating the furnace to an inner temperature of 920° to 1120° C. and introducing into the furnace a gaseous mixture containing CO and $CO_2$ in a molar ratio of from 60:40 to 100:0, continuing the heating and introduction of gaseous mixture for a period of from 0.5 to 7 hours, removing a reduced ore from the furnace, grinding the reduced ore in the presence of water, subjecting the ground reduced ore to magnetic separation and recovering as magnetic fraction a ferronickel concentrate containing at most 35% of the iron present in the iron and nickel containing lateritic ore used as starting material.

In the most preferred embodiment of the process of this invention a ferronickel concentrate is produced by introducing a mixture of a sulphur compound, selected from sodium sulphate, potassium sulphate, ammonium sulphate, FeS and $FeS_2$, and a ground lateritic ore containing 0.25 to 1.2%w of nickel and 10 to 50%w of iron into a furnace, heating the furnace to an inner temperaure of 950° to 1050° C. and introducing a gaseous mixture containing CO and $CO_2$ in a molar ratio of from 65:35 to 85:15, into the furnace, continuing the heating and introduction of gaseous mixture for a period of 0.5 to 3 hours, removing a reduced ore from the furnace, grinding the reduced ore in the presence of water, subjecting the ground reduced ore to magnetic separation and recovering as magnetic fraction a ferronickel concentrate containing at most 25% of the iron present in the iron and nickel containing lateritic ore used as starting material.

In another, less preferred, embodiment of the process of this invention at least part of the reducing CO and $CO_2$ containing gas mixture is generated in situ by reacting carbon that has been incorporated into the ground lateritic ore with oxygen that is released upon heating the ore at the required conversion temperature of from 920° to 1120° C. In that event the amount of carbon to be employed is to be ajusted so as to observe the production of a gaseous mixture comprising CO and $CO_2$ in the critical molar ratio of from 60:40 to 100:0, hence both conversion of carbon into CO only or into $CO_2$ only is to be avoided. If the partial oxygen pressure in the heated system would be so high as to convert carbon into too much $CO_2$ it is preferred to sweep the system with nitrogen gas, with an other inert gas or with a slightly reducing atmosphere.

An additional advantage of the new process is that any cobalt compounds present in the lateritic ore used as starting material are obtained almost quantitatively in the magnetic fraction.

EXAMPLE

The ground nickel ore used in the reduction experiments had, after drying at 105° C., the following chemical composition and particle distribution:

| Element | Analysis, % w | particle size distribution |
|---|---|---|
| Ni | 0.77 | $+90 \times 10^{-6}$m: 1% |
| Fe | 40.2 | $+56 \times 10^{-6}$m: 13% |
| Si | 7.5 | $+45 \times 10^{-6}$m: 9% |
| Al | 4.5 | $+30 \times 10^{-6}$m: 18% |
| Cr | 3.2 | $+20 \times 10^{-6}$m: 13% |
| Mg | 0.4 | $-20 \times 10^{-6}$m: 46% |
| Co | 0.08 | |
| Mn | 0.93 | |
| O | 31.4 | |
| Rest | 9.0 | |

The residual content was determined by measuring the weight loss resulting from heating the ore for 3 hours at 1000° C. In the reduction experiments 5 g of ore was mixed with FeS or $Na_2SO_4$ and subsequently placed in an alumina tray in a tubular furnace having an inner diameter of 4 cm. A $CO/CO_2$ gas mixture was introduced in the furnace, where upon the furnace was heated to the reaction temperature. Once this temperature had been reached, isothermal heating was carried out while passing a stream of a $CO/CO_2$ gas mixture at a rate of 14 l/h for a length of time which was taken as the reaction time. The furnace was then cooled to room temperature under the same atmosphere in order to prevent reoxidation. The results of a number of experiments as function of a number of parameters; reaction temperature (T), $CO/CO_2$ ratio in the gas atmosphere, reaction time (t) and the additive FeS or $Na_2SO_4$, are summarized in Table I. This table relates the percentage Ni and Fe recovery to the amounts of Ni and Fe in the starting material. The recovery was determined by microprobe analysis of the FeNi phase and by chemical analysis able to distinguish zero-valent Ni or Fe from oxidic Ni or Fe. The Ni content of the FeNi phase was determined by microprobe analysis, iron oxides contained in the non-metallic phase are considered non-removed iron.

TABLE I

| Tests | T (°C.) | t (h) | $CO/CO_2$ | additive (g per 100 g ore) | particle size FeNi-phase ($10^{-6}$m) | Ni recovery in FeNi (%) | Fe recovery in FeNi (%) | Ni content in FeNi (% w) |
|---|---|---|---|---|---|---|---|---|
| I | 1000 | 0.5 | 70/30 | —* | <1 | 30 | 8 | 8 |
| II | 1000 | 5 | 70/30 | FeS 5 | >5 | >95 | 29 | 6 |
| III | 900* | 5 | 70/30 | FeS 5 | <1 | ~75 | 28 | 4 |
| IV | 800* | 5 | 70/30 | FeS 5 | <1 | ~15 | 15 | 2 |
| V | 1000 | 0.5 | 70/30 | FeS 5 | >5 | >95 | 45 | 4 |
| VI | 1000 | 5 | 65/35 | FeS 5 | ~5 | 80 | 6 | 25 |
| VII | 1000 | 5 | 55/45* | FeS 5 | <1 | 2 | 0.4 | — |
| VIII | 1000 | 0.5 | 70/30 | $Na_2SO_4$ 5 | >5 | >95 | 30 | 7 |
| IX | 1000 | 5 | 70/30 | $Na_2SO_4$ 5 | >5 | >95 | 20 | 8 |
| X | 1000 | 0.5 | 65/35 | $Na_2SO_4$ 5 | >5 | 87 | 6 | 30 |
| XI | 1000 | 5 | 65/35 | $Na_2SO_4$ 5 | >5 | 94 | 5 | 40 |
| XII | 1000 | 0.5 | 70/30 | FeS 1 | 1 | >95 | 29 | 6 |
| XIII | 1000 | 0.5 | 70/30 | FeS 10 | >5 | >95 | 26 | 6 |

*for comparison

Subsequently tests II, VI and IX were repeated on a larger scale but otherwise under the same conditions in order to prepare samples each of 25 g.

The samples were ground for 20 minutes after the addition of 9.5 g water per sample. After magnetic separation the results shown in Table II were obtained. In this Table II % metal recovery concerns the total amount of metallic constituents contained in the magnetic fraction, relative to the starting material employed in the reduction reaction.

TABLE II

| Sample | weight fraction: magnetic fraction (% w) | weight fraction: non-magnetic fraction (% w) | metal recovery, (%): Ni | metal recovery, (%): Fe |
|---|---|---|---|---|
| II | 16 | 84 | 92 | 21 |
| VI | 7 | 93 | 70 | 5 |
| IX | 15 | 85 | 94 | 22 |

Magnetic separation of wet ground samples according to tests I, III and IV was unsuccesful, i.e. less than 5%w of magnetic fraction was obtained on each occasion, while the Ni recovery in the magnetic fraction was less than 15%, relative to the Ni present in the ore employed as starting material used in the reduction reaction.

We claim:

1. A process for the preparation of a ferronickel concentrate, comprising the steps of:

mixing a sulphur compound and a lateritic ore containing 0.25 to 1.2% wt of nickel and 10 to 50% wt of iron;

reducing the mixture of the sulphur compound and lateritic ore at a temperaure of 920° to 1120° C. with a gas mixture containing CO and $CO_2$ in a molar ratio of from 60:40 to 100:0, the sulfur compound in the mixture presenting the sole agent controlling particle growth of the metallized nickel-containing phase during reduction;

grinding the reduced reaction product; and magnetically separating the ground reaction product to produce a magnetic fraction which contains a maximum of 35% of the iron originally contained in the lateritic ore.

2. A process for producing a ferronickel concentrate, comprising the steps of:

introducing a mixture of sulphur compound and a ground lateritic ore containing 0.25 to 1.2% wt of nickel and 10 to 50% wt of iron oxide into a furnace;

heating the furnace to an inner temperature of 920° to 1120° C.;

introducing into the furnace a gaseous mixture containing CO and $CO_2$ in a molar ratio of from 60:40 to 100:0;

continuing the heating and introduction of gaseous mixture for a period of from 0.5 to 7 hours, the sulphur compound in the mixture presenting the sole agent controlling particle growth of the metallized nickel-containing phase during heating;

removing the reduced ore from the furnace;

grinding the reduced ore in the presence of water;

subjecting the ground reduced ore to magnetic separation; and recovering as magnetic fraction of ferronickel concentrate containing at most 35% of the iron present in the iron and nickel containing lateritic ore used as starting material.

3. A process for producing a ferronickel concentrate which comprises the steps of:

introducing a mixture of a sulphur compound, selected from sodium sulphate, potassium sulphate, ammonium sulphate, FeS and $FeS_2$, and a ground lateritic ore containing 0.25 to 1.2% wt of nickel and 10 to 50% wt of iron into a furnace;

heating the furnace to an inner temperature of 950° to 1120° C.;

introducing a gaseous mixture containing CO and $CO_2$ in a molar ratio of from 65:35 to 85:15 into the furnace;

continuing the heating and introduction of gaseous mixture for a period of 0.5 to 3 hours, the sulfur compound in the mixture presenting the sole agent controlling particle growth of the metalized nickel-containing phase during heating;

removing a reduced ore from the furnace;

grinding the reduced ore in the presence of water;

subjecting the ground reduced ore to magnetic separation; and recovering as magnetic fraction of ferronickel concentrate containing at most 25% of the iron present in the iron and nickel containing lateritic ore used as starting material.

4. A process according to claim 1, wherein a $CO/CO_2$ ratio of from 65:35 to 85:15 is used.

5. A process according to claims 1 or 4, wherein the sulphur compound is present in an amount of 1.5 to 10%w, calculated as sulphur to oxidic iron.

6. A process according to claims 1 to 5, wherein FeS or $FeS_2$ is used as sulphur compound.

7. A process according to claims 1 to 5, wherein an alkali metal or alkaline earth metal sulphate is used as sulphur compound.

8. A process according to claim 7, wherein sodium sulphate is used.

9. A process according to claims 1 to 8, wherein a magnetic fraction is obtained which contains less than 25%w of the iron present in the ore.

10. A process according to claims 1 to 9, wherein the ore is reacted with 2 to 20 mol CO per mol oxidic nickel.

* * * * *